United States Patent [19]

Kalnin

[11] 4,388,227

[45] Jun. 14, 1983

[54] INTERCALATION OF GRAPHITIC CARBON FIBERS

[75] Inventor: Ilmar L. Kalnin, Millington, N.J.

[73] Assignee: Celanese Corporation, New York, N.Y.

[21] Appl. No.: 17,006

[22] Filed: Mar. 2, 1979

[51] Int. Cl.[3] ..... D01F 6/18; D01F 9/14

[52] U.S. Cl. ..... 252/510; 106/307; 106/308 B; 252/500; 252/506; 252/511; 260/429 R; 264/29.1; 264/29.7; 423/447.1; 423/447.7; 423/453; 423/460; 528/481; 528/487; 528/490; 528/502; 528/503

[58] Field of Search ..... 252/510, 511, 506, 500; 528/481, 487, 490, 502, 503; 423/447.1, 447.7, 453, 460; 106/307, 308 B; 264/29.1, 29 M; 260/429 R

[56] References Cited

U.S. PATENT DOCUMENTS

| | | | |
|---|---|---|---|
| 3,656,904 | 4/1972 | Ram | 252/502 |
| 4,073,869 | 2/1978 | Kalnin | 423/447.1 |
| 4,119,655 | 10/1978 | Hulme | 260/429.5 |

*Primary Examiner*—Stanford M. Levin

*Attorney, Agent, or Firm*—Burns, Doane, Swecker & Mathis

[57] ABSTRACT

The formation of improved intercalated graphitic carbon fibers of further diminished electrical resistivity (i.e., increased electrical conductivity) is made possible. Not only is the specific electrical resistivity of the resulting fibers reduced (e.g., to extremely low levels no greater than that of copper in preferred embodiments), but the desirable tensile properties of the fibers are maintained at a satisfactory level even after intercalation. A carbonaceous fibrous material containing the usual turbostratic graphitic carbon which is derived from an acrylonitrile homopolymer or a closely related copolymer (as defined) is selected and is structurally modified in a manner which has been found to render it particularly suited for intercalation as evidenced by a further reduction in the electrical resistivity of the resulting intercalated fibrous material while retaining other desirable properties. More specifically, the carbonaceous fibrous material (as defined) prior to intercalation with an electron acceptor intercalating agent is modified via an atypical extremely high temperature treatment so as to yield a modified structure which can be evidenced upon wide angle x-ray diffraction analysis, i.e. resolved graphitic Miller index (100) and (101) reflections and the presence of a (112) reflection are observed, which surprisingly has been found capable of subsequently yielding an improved intercalated product having a substantially reduced electrical resistivity. The intercalated product finds utility as an improved lightweight electrical conductor.

27 Claims, 6 Drawing Figures

INTERCALATION OF GRAPHITIC CARBON FIBERS

BACKGROUND OF THE INVENTION

It has long been known that the unique crystalline structure of graphite makes it anisotropic with respect to electrical charge carriers. Its structure basically comprises planes of hexagonally arrayed aromatically bound carbon atoms. Hence, each of such planes has $\pi$ clouds of electrons above and below it. These electron clouds have been said to contribute to its anisotropic conductive behavior, the higher conductivity being in the direction parallel to the aromatic carbon plates. This conductivity is approximately 5 percent that of copper, at best.

It also long has been known that it is possible to form carbonaceous fibrous materials which incorporate to at least some degree graphitic carbon. Such carbonaceous fibrous materials prior to intercalation can be formed by the thermal treatment of a variety of polymeric fibrous materials in accordance with procedures known in the art. See, for instance, the following commonly assigned U.S. Patents which disclose the formation of carbon fibers which include the presence of graphitic carbon beginning with an acrylic fibrous precursor (as defined): Nos. 3,656,904; 3,775,520; 3,818,082; 3,900,556; 3,925,524; and 3,954,950. Most of the commercially available carbon fibers available today are formed at a maximum temperature well below 2000° C. It has been the practice heretofore rarely to form carbonaceous fibrous materials at maximum processing temperatures higher than approximately 2700° to 2900° C. since the production of any higher temperatures have been more difficult to achieve and control and more expensive to sustain over an extended period of time. The graphitic carbon present in such carbonaceous fibrous materials has been turbostratic (i.e., the graphitic basal planes have tended to be parallel but randomly oriented with respect to the crystallographic $a_1$ and $a_2$ axes of the hexagonal lattice). When subjected to wide angle x-ray analysis such heretofore produced fibers derived from an acrylic fibrous precursor have exhibited a single diffraction peak comprising unresolved Miller index (100, 101) reflections and the absence of a (112) reflection. U.S. Pat. No. 4,005,183 discloses carbon fibers containing graphitic carbon which are derived from pitch which when subjected to wide angle x-ray analysis exhibit resolved Miller index (100) and (101) reflections and the presence of a (112) reflection. It is stated in this patent that at Col. 3, lines 38 et seq., that fibers derived from the processing of acrylic fibers to 2500° to 3000° C. and higher exhibit unresolved Miller index (100, 101) reflections and the absence of a (112) reflection.

It further has been recognized that certain elements or molecules, when diffused into a graphite lattice, assume positions interstitial to the aromatic planes and improve graphite conductivity. Such positioning of elements or molecules within the graphitic carbon structure has been termed "intercalation" and commonly has produced a reduced electrical resistivity. Ubbeholde, for example, found that the interstitial compound formed between individual graphite crystals and nitric acid has a volume conductivity almost equal to that of copper (which is approximately $0.6\times10^6$ ohms$^{-1}$ cm.$^{-1}$) when measured parallel to the aromatic planes (A. R. Ubbeholde, Proc. Roy. Soc., A304, 25, 1968). The following are additional representative publications which concern the intercalation of graphite: U.S. Pat. Nos. 3,962,133; 3,984,352; 3,409,563; 4,035,434; 4,083,885; and 4,119,655; "Rare Earth Graphite Intercalation Compounds" by W. E. Craven and W. Ostertag appearing in *Carbon*, Vol. 4, pages 223–226 (1966); "Graphite Intercalation Compounds With Chlorides of Manganese, Nickel and Zinc" by E. Stumpp and F. Werner appearing in *Carbon*, Vol. 4, page 538 (1966); "High Electrical Conductivity in Graphite Intercalated With Acid Fluorides" by F. L. Vogel, G. M. T. Foley, C. Zeller, E. R. Falardeau and J. Gan appearing in *Materials, Science and Engineering*, Vol. 31, pages 261–265 (1977), "The Electrical Conductivity of Graphite Intercalated With Superacid Fluorides: Experiments With Antimony Pentafluoride" by F. L. Vogel appearing in *Journal of Materials Science*, Vol. 12, pages 982–986 (1977); "Very High Electrical Conductivity in $AsF_5$-Graphite Intercalation Compounds" by E. R. Falardeau, G. M. T. Foley, C. Zeller, and F. L. Vogel appearing in *Journal of the Chemical Society*, Chemical Communications, pages 389–390 (1977); "Chemistry of Graphite Intercalation by Nitric Acid" by W. C. Forsman, F. L. Vogel, D. E. Carl and J. Hoffman appearing in *Carbon*, Vol. 16, pages 269–271 (1978); and "Charge Transfer in Graphite, Nitrate and the Ionic Salt Model" by S. Loughin, R. Grayeski, and J. E. Fisher appearing in *J. Chem. Phys.* 69(8), pages 3740–3743 (1978).

Additionally, it is known that carbonaceous fibrous materials containing graphitic carbon can be intercalated to form a fibrous product of reduced electrical resistivity. However, it heretofore has not been possible to reduce the electrical resistivity of such carbon fibers via intercalation to the low levels achievable with other forms of graphite such as individual graphite single crystals or highly oriented pyrolytic graphite (HOPG). Such inability to achieve extremely high levels of electrical conductivity is believed to be traceable to at least some degree to the turbostratic nature of the graphitic carbon crystallites inherently present in such fibers (i.e., the lack of orientation within the parallel layers of the crystallites comprising the fiber).

The following are representative disclosures which discuss at least in part the formation of a graphite intercalation compound within a carbonaceous fibrous material: "Interstitial Compounds of Potassium With Carbon Fibers" by C. Herinckx, R. Perret and W. Ruland appearing in *Carbon*, Vol. 10, pages 711–722 (1972); German Pat No. 2,537,272; "Electrical Resistivity of Nitrate Intercalated Graphite Fibers" by F. L. Vogel appearing in the Proceedings, 4th London International Conference on Carbon and Graphite (1976); U.S. Ser. No. 897,443, filed Apr. 18, 1978; and "The Intercalation of Bromine in Graphitized Carbon Fibers and Its Removal" by J. G. Hooley and V. R. Deitz appearing in *Carbon*, Vol. 16, pages 251–257 (1978).

It is an object of the present invention to provide an improved process for the intercalation of graphitic carbon fibers.

It is an object of the present invention to provide an improved carbonaceous fibrous material containing graphitic carbon which is particularly suited for intercalation.

It is an object of the present invention to provide improved intercalated graphitic carbon fibers having an extremely low specific electrical resistivity which in a preferred embodiment is no greater than that of copper.

It is an object of the present invention to provide improved intercalation graphitic carbon fibers which advantageously exhibit desirable tensile properties such as strength and initial modulus in addition to a reduced electrical resistivity.

It is an object of the present invention to provide improved intercalated graphitic carbon fibers which because of their extremely low specific electrical resistivity and highly satisfactory tensile properties can be utilized to particular advantage as lightweight electrical conductors.

These and other objects, as well as the scope, nature, and utilization of the claimed invention will be apparent to those skilled in the art from the following detailed description and appended claims.

SUMMARY OF THE INVENTION

It has been found that in a process for the formation of an intercalated carbonaceous fibrous material of increased electrical conductivity wherein a carbonaceous fibrous material containing at least 90 percent carbon by weight which incorporates turbostratic graphitic carbon and is derived from a fibrous material of an acrylonitrile homopolymer or an acrylonitrile copolymer containing at least about 98 mole percent of acrylonitrile units and up to about 2 mole percent of one or more other monovinyl units copolymerized therewith is contacted with at least one electron acceptor intercalating agent; that improved results are achieved by providing said carbonaceous fibrous material prior to said intercalation in a modified form as evidenced by the ability to exhibit resolved graphitic Miller index (100) and (101) reflections and a (112) reflection when subjected to wide angle x-ray diffraction analysis.

A carbonaceous fibrous material is provided which incorporates graphitic carbon, exhibits an average tensile strength of at least about 200,000 psi, an average Young's modulus of at least 70,000,000 psi, and a density of at least 2.1 grams/cm.$^3$, contains at least 90 percent carbon by weight, and has a modified internal structure which renders it particularly suited for intercalation which was formed by heating in a non-oxidizing atmosphere at a temperature of greater than 3100° C. a carbonaceous fibrous material containing turbostratic graphitic carbon which previously had been thermally processed at a maximum temperature below 3000° C. during the formation thereof and which was derived from a fibrous material of an acrylonitrile homopolymer or an acrylonitrile copolymer containing at least about 98 mole percent of acrylonitrile units and up to about 2 mole percent of one or more other monovinyl units copolymerized therewith, thereby rendering the carbonaceous fibrous material capable of undergoing intercalation with an electron acceptor intercalation agent to form an intercalated fibrous product of increased electrical conductivity.

Additionally, in a preferred embodiment an intercalated carbonaceous fibrous material exhibiting a specific electrical resistivity no greater than that of copper is provided which was formed by (a) heating a carbonaceous fibrous material containing at least 90 percent carbon by weight derived from a fibrous material of an acrylonitrile homopolymer or an acrylonitrile copolymer containing at least about 98 mole percent of acrylonitrile units and up to about 2 mole percent of one or more other monovinyl units copolymerized therewith which incorporates turbostratic graphitic carbon and exhibits the usual unresolved Miller index (100, 101) doublet reflection and the absence of a (112) reflection when subjected to wide angle x-ray diffraction analysis in a non-oxidizing atmosphere at a temperature of at least 3000° C. whereby the structure thereof is modified and rendered capable of exhibiting resolved Miller index (100) and (101) reflections and the presence of a (112) reflection when subjected to wide angle x-ray diffraction analysis, and (b) contacting the previously modified carbonaceous fibrous material with at least one electron acceptor intercalating agent capable of imparting the specific electrical resistivity.

DESCRIPTION OF PREFERRED EMBODIMENTS

Figures 1, 2:
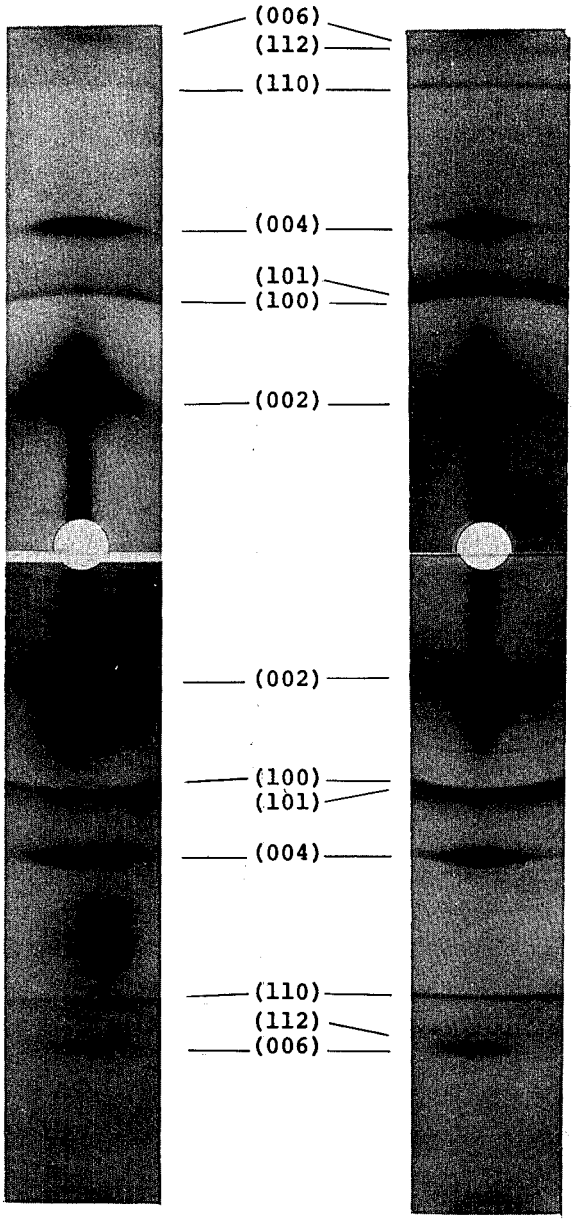
Fig. 1 (Prior Art)
FIG. 1 is a photograph (direct print of negative) exhibiting typical reflections formed when a carbonaceous fibrous material containing turbostratic graphitic carbon derived from an acrylonitrile homopolymer which was thermally processed at a maximum temperature of approximately 2850° C. was subjected to wide angle x-ray diffraction analysis. The equatorial reflections of the fiber were obtained through the use of a Debye-Scherrer camera. It will be apparent to those skilled in wide angle x-ray analysis that the Miller index (100) and (101) reflections are unresolved and overlap and that a (112) reflection is absent.
FIG. 2 is a photograph (direct print of negative) exhibiting typical reflections formed when the carbonaceous fibrous material of FIG. 1 has been heated in a non-oxidizing atmosphere provided at approximately 3050° C. for approximately 96 seconds. The equatorial reflections of the fiber were obtained through the use of a Debye-Scherrer camera. It will be apparent to those skilled in wide angle x-ray diffraction analysis that the Miller index (100) and (101) reflection lines now are resolved and are identifiable and that a (112) reflection is present for the first time. Such carbonaceous fibrous material has been found to be particularly suited for intercalation and will yield an intercalated product having a substantially lower specific electrical resistivity than the fiber of FIG. 1.

The carbonaceous fibrous material which is selected for intercalation in accordance with the concept of the present invention is derived from an acrylonitrile homopolymer or a closely related acrylonitrile copolymer (defined hereafter) and has been structurally modified (as described hereafter) to render it particularly suited for intercalation with one or more electron acceptor intercalating agents.

In a particularly preferred embodiment the carbonaceous fibrous material is derived from fibrous material of an acrylonitrile homopolymer. However, the carbonaceous fibrous material alternatively may be derived from an acrylonitrile copolymer containing at least about 98 mole percent of acrylonitrile units and up to about 2 mole percent of one or more other monovinyl units copolymerized therewith. Representative monovinyl units which can be copolymerized with acrylonitrile include: styrene, methyl acrylate, methyl methacrylate, vinyl acetate, vinyl chloride, vinylidene chloride, vinyl pyridine and the like, or a plurality of such units. Such carbonaceous fibrous materials following structural modification are amenable to the formation of an improved intercalated product of increased electrical conductivity which maintains satisfactory tensile properties (i.e., tensile strength and Young's modulus).

The carbonaceous fibrous material prior to structural modification contains at least 90 percent carbon by weight, preferably at least 95 percent carbon by weight, and most preferably at least 98 percent carbon by weight. Such fibrous materials prior to structural modification preferably also exhibit an average tensile strength of at least about 200,000 psi, and most preferably at least 250,000 psi (e.g. at least 300,000 psi); an average Young's modulus of at least 70,000,000 psi (e.g., at least 80,000,000 psi); preferably a density of at least 2.00 grams/cm.$^3$; and preferably a denier per filament of about 0.6 to 1.5. The density conveniently can be determined in accordance with the standard density gradient technique, ASTM D1505.

Such carbonaceous fibrous materials prior to structural modification are commercially available and can be formed in accordance with known techniques. Representative techniques for forming such carbonaceous fibrous materials are disclosed in commonly assigned U.S. Pat. Nos. 3,656,904; 3,775,520; 3,818,082; 3,900,556, 3,925,525; and 3,954,950. Celion GY-70 carbon fibers which are commercially available from the Celanese Corporation may be selected for structural modification as described hereafter. It has been the practice heretofore rarely to form carbonaceous fibrous materials at maximum processing temperatures higher than 2700° to 2900° C. (i.e., they commonly are thermally processed at a maximum temperature below 3000° C. during their formation) since the production of such higher temperatures have been more difficult to achieve and to control and more expensive to sustain over an extended period of time. The carbonaceous fibrous materials commonly are provided in the configuration of multifilament yarns or multifilament tows.

Figure 3:
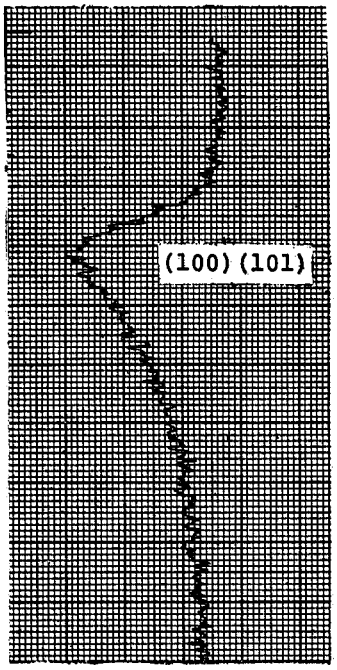
Fig. 3 (Prior Art)
FIG. 3 is a microdensitometer trace obtained from the original wide angle x-ray diffraction photograph of FIG. 1 showing the unresolved Miller index (100, 101) doublet reflection.
Figure 5:
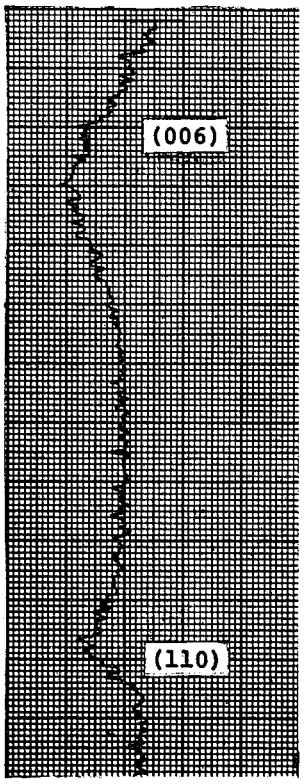
Fig. 5 (Prior Art)
FIG. 5 is a microdensitometer trace obtained from the original wide angle x-ray diffraction photograph of FIG. 1 at the area where a Miller index (112) reflection would appear if it were present. No (112) reflection is present.

The carbonaceous fibrous material incorporates the usual turbostratic graphitic carbon found in such carbonaceous fibrous materials (i.e., the graphitic basal planes have tended to be parallel but randomly oriented with respect to the crystallographic $a_1$ and $a_2$ axes of the hexagonal lattice). Such fibrous material when subjected to wide-angle x-ray diffraction analysis prior to structural modification also exhibits an unresolved Miller index (100, 101) doublet reflection and the absence of a (112) reflection. The unresolved nature of the (100) and (101) reflections can be observed from a visual inspection of the wide-angle x-ray diffraction photograph as well as from the single peak present on a microdensitometer trace obtained from such photograph. The absence of the (112) reflection can be confirmed by a visual inspection of the wide-angle x-ray diffraction photograph as well as from the absence of a peak on the microdensitometer trace obtained from the photograph. See for instance FIGS. 1, 3 and 5.

Prior to intercalation the carbonaceous fibrous material is structurally modified by heating in a non-oxidizing atmosphere at a temperature of at least 3000° C. to render it capable of undergoing intercalation to form an intercalated fibrous product of increased electrical conductivity. Suitable non-oxidizing atmospheres include nitrogen, argon, and helium. In a preferred embodiment the carbonaceous fibrous material is thermally processed in a non-oxidizing atmosphere at a temperature greater than 3100° C. (e.g. greater than 3100° C. to 3200° C.). Temperatures up to approximately 3500° C. may be utilized provided the pressure is increased above atmospheric pressure. The carbonaceous fibrous material can be structurally modified on a continuous basis by continuously passing a continuous length of the same through the extremely high temperature heating zone while under a longitudinal tension at least sufficient to prevent visible sagging. Representative residence times range from about 5 seconds to 5 minutes depending upon the temperature of the heating zone. Commonly residence times of about 30 seconds to 3 minutes are utilized. Longer residence times can be employed without commensurate advantage. Suitable equipment which can be utilized to produce the heated non-oxidizing atmosphere used to accomplish the structural modification include inductively heated tube furnaces, direct resistance heated tube furnaces, arc image furnaces, laser beams, hot plasma torches, etc.

Following the structural modification treatment described above the carbonaceous fibrous material continues to exhibit mostly turbostratic graphitic carbon; however, it now surprisingly is capable upon intercalation with at least one electron acceptor intercalating agent of exhibiting a substantially enhanced electrical conductivity.

Figure 6:
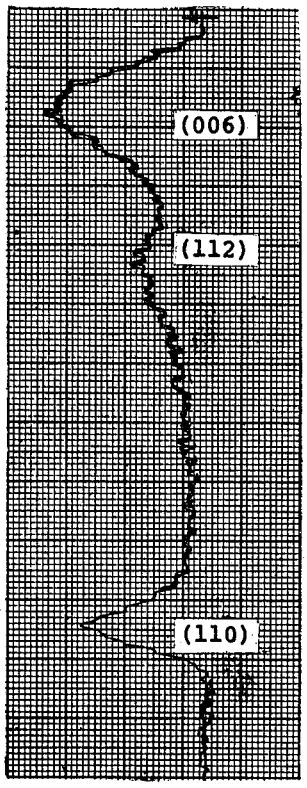
FIG. 6 is a microdensitometer trace obtained from the original wide angle x-ray diffraction photograph of FIG. 2 wherein the presence of a Miller index (112) reflection is apparent.

Following the structural modification the carbonaceous fibrous material preferably continues to exhibit an average tensile strength of at least about 200,000 psi, and most preferably at least 250,000 psi (e.g. at least 300,000 psi); an average Young's modulus of at least 70,000,000 psi (e.g. at least 80,000,000 psi) and a denier per filament of about 0.6 to 1.5. The density is increased to at least 2.10 grams/cm.$^3$ following the structural modification. Also, the carbonaceous fibrous material following structural modification exhibits resolved Miller index (100) and (101) reflections and the presence of a (112) reflection. The presence of both the (100) and (101) reflections can be observed from an inspection of the wide-angle x-ray diffraction photograph as well as from the two peaks present on a microdensitometer trace obtained from the photograph corresponding to the resolved Miller index (100) and (101) reflections. The presence of the (112) reflection can be confirmed by visual inspection of the wide-angle x-ray diffraction photograph as well as from the peak on a microdensitometer trace obtained from the photograph in the area of the (112) line. See FIGS. 2, 4, and 6.

When preparing the photographs of FIGS. 1 and 2 a filament was placed in a 0.3 mm. thin walled glass capillary and mounted in a Debye-Scherrer camera which had a diameter of 114.6 mm. X-ray patterns are obtained using Ilford Industrial G film, and a Philips XRG 3000 x-ray generator operated at 40 KV and 20 mA. Exposure times of 3 hours were used and the film was developed following the procedures recommended by the manufacturer. In this manner x-ray patterns showing the equatorial reflections of the fibers were obtained. The Miller indices corresponding to the reflections are assigned using the graphite structure described in the Johnson Powder Diffraction File Card No. 23-64.

To further evaluate photographs similar to those of FIGS. 1 and 2, the microdensitometer intensity traces obtained therefrom can be subjected to additional analysis. Such microdensitometer traces (e.g. FIGS. 3 to 6) initially can be prepared by use of a Joyce Loebl & Co. Ltd. double beam recording microdensitometer, Model Mark III CS, with the ratio arm set at 10:1 and a recording slit of 1 mm. by 7 mm. Such further analysis of the microdensitometer traces as described hereafter can be useful in further confirming in an quantitative manner the character of the (100) and (101) reflections and the presence or absence of a (112) reflection.

Figure 4:
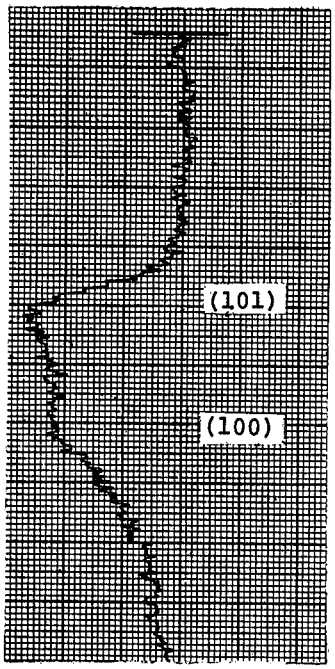
FIG. 4 is a microdensitometer trace obtained from the original wide angle x-ray diffraction photograph of FIG. 2 showing the resolved Miller index (100) and (101) reflections.

This further quantitative analysis can be particularly useful when considering the nature of the (100) and (101) peaks, since as seen in FIG. 4 these peaks even though resolved still may overlap to some extent. First the half width $\beta_{110}$ (i.e. the full width at half the peak height) of the (110) reflection is measured. Next the half width $\beta_{100}$ (i.e. the half width which the (100) reflection would have in the absence of the partially overlapped (101) reflection) is calculated from the measured half width of the (110) reflection using the Scherrer equation for line broadening:

$$\beta_{(hkl)} = \frac{K\lambda}{t\cos\theta_{(hkl)}},$$

where K is a constant which has a value of about 1.8 for turbostratic materials, $\lambda$ is the wavelength of the x-ray radiation used, t is the size of the crystallites and $\theta$ is the Bragg angle for the (hkl) reflection. The use of this relationship implies that the crystallite size and character in the <100> direction is the same as that in the <110> direction. Since both of these directions lie in the basal planes, this is a reasonable assumption. A (100) peak is then re-constructed equiproportional to the (110) peak, i.e., having an identical shape to that of the (110) reflection, but scaled according to the height of the measured (100) reflection and the calculated half width $\beta_{100}$. The area of this peak is subtracted from the total area of the overlapped (100, 101) doublet and this difference is taken as the area of the (101) reflection. The respective areas under the peaks referred to above, are measured quantitatively by means of a standard planimeter, (Keuffel and Esser, No. 2167). Since the area under the microdensitometer of an (hkl) reflection is proportional to its integrated intensity, $I_{hkl}$, the ratio: area of (101)/area of (100) is a measure of the degree of three-dimensional graphite present in the material.

Whenever the integrated intensity ratio of $I_{101}/I_{100}$ is found to be at least 0.4, this is considered to indicate substantially resolved (100) and (101) reflections. In a preferred embodiment the integrated intensity ratio of $I_{101}/I_{100}$ is at least 0.9. Whenever the integrated intensity ratio of $I_{101}/I_{100}$ is much below 0.4, this is considered to further confirm the unresolved nature of the reflection.

Additionally, the degree of three-dimensional graphiticity can be characterized by the integrated intensity ratio of the (112) and (110) reflection lines, i.e., by the ratio of the areas underneath the respective peaks of the microdensitometer trace taken from a wide-angle x-ray diffraction photograph showing these lines. Since these are already separated, no mathematical resolution is necessary, and the respective areas can be measured directly by means of a standard planimeter. Whenever the ratio of $I_{112}/I_{110}$ is found to be at least 0.3, this is considered to indicate the substantial presence of a (112) reflection. In a preferred embodiment the $I_{112}/I_{110}$ is at least 0.5. Whenever the $I_{112}/I_{110}$ is much below 0.3, this is considered to further confirm the absence of a meaningful (112) reflection.

The desired intercalation can conveniently be carried out in accordance with known techniques by simply contacting at least one electron acceptor intercalating agent with the structurally modified carbonaceous fibrous material for a sufficient length of time. Regardless of the intercalating agent selected an intercalated product of substantially enhanced electrical conductivity results following such structural modification. As indicated, such substantial change in electrical conductivity of the intercalated product is considered to be surprising and incapable of simple explanation since the fibrous product continues to incorporate largely imperfect turbostratic graphitic carbon. In a preferred embodiment an intercalated fibrous product is formed having a specific electrical resistivity no greater than that of copper.

Representative electron acceptor intercalating agents which can be utilized to accomplish the intercalation are protonic acids having a negative Hammett acidity function of at least 11.0, nitric acid, a Lewis acid, and mixtures of these. Suitable protonic acids having a negative Hammett acidity function of at least 11 include hydrogen fluoride, sulfuric acid, trifluoroacetic acid, fluorosulfonic acid, chlorosulfonic acid, methanefluorosulfonic acid, methanechlorosulfonic acid, and mixtures thereof. Mixtures of sulfuric acid and nitric acid can be utilized. Suitable Lewis acids include FCl, ICl, $ClF_3$, $BF_3$, $AlF_3$, $FeCl_3$, $AlCl_3$; tetrahalides such as $SiF_4$, $HfF_4$, $TiF_4$, $TiCl_4$, $ZrF_4$, $ZrCl_4$, $SF_4$, $SeF_4$, and $SeCl_4$; and pentahalides such as $PF_5$, $PCl_5$, $NbF_5$, $NbCl_5$, $TaF_5$, $TaCl_5$, $AsF_5$, $AsCl_5$, $SbF_5$ and $SbCl_5$. Other suitable Lewis acid intercalating agents are $IF_7$, $CrO_2Cl_2$, $CrO_3$, and $SO_3$. The particularly preferred Lewis acids for use as intercalating agents are $SbF_5$ and $AsF_5$. When $FeCl_3$ and $AlCl_3$ are selected as intercalating agents, they can be assisted to advantage by the presence of gaseous fluorine or chlorine during the intercalation.

When the structurally modified fibers are intercalated in accordance with the concept of the present invention and the intercalated product is subjected to wide-angle x-ray analysis, it is found that the original reflections (i.e., those of FIG. 2) tend to disappear. In their place appear much larger "d" spacings than those present prior to intercalation, as well as some other diffuse lines which appear at irregular intervals. For instance, it has been found that structurally modified fibers which are intercalated with antimony pentafluoride, or fluorosulfonic acid and antimony pentafluoride, or fluorosulfonic acid and arsenic pentafluoride, possess large "d" spacings and at least one measurable spot or line in the range of 10.5 to 14 Angstroms and possibly also in the range of 20.0 to 29.0 Angstroms.

It has been found that following intercalation in accordance with the concept of the present invention the intercalated fibrous product commonly retains at least 40 percent of the average tensile strength exhibited by the carbonaceous fibrous material immediately prior to intercalation. Accordingly, the intercalated fibrous product can exhibit highly satisfactory tensile properties when one considers the high tensile properties commonly exhibited by a carbonaceous fibrous material starting material which is derived from an a crylonitrile homopolymer or a closely related copolymer (as defined). The intercalated fibrous product preferably exhibits a tensile strength of at least 100,000 psi, and an average Young's modulus of at least 50,000,000 psi. The intercalated product can be utilized as an electrical conductor.

Because of the low density, in comparison to the metallic conductors, and the high current-carrying capability, the intercalated fiber conductor has great utility in numerous applications. Thus, when fabricated in the form of a fine low denier yarn, it is particulary suitable as a fine gauge magnet wire. Alternately, it may be plied, woven or braided to form stranded wire cables or tapes for use as lightweight electroconductors in transportation equipment, such as space vehicles, aircraft, naval vessels, trucks, etc., or in the communications and power transmission industries. Also, these products may be useful as efficient electrode materials in various non-aqueous batteries or as collectors for nonaqueous electroseparation processes.

The electrical conductivity and electrical resistivity of a carbonaceous fibrous material containing graphitic carbon before or after intercalation can be determined by the testing of individual filaments in accordance with a standard four point or four contact measuring technique designed to eliminate unwanted contact resistance. Principles of this method are presented in standard textbooks, such as "Electrical Measurements in Theory and Application", by A. W. Smith, 4th Edition, McGraw Hill Book Co., N.Y. (1948), which is herein incorporated by reference. More specifically, the filaments first are placed upon substrates comprising alumina ceramic plates possessing four spaced platinum strip contacts, and are attached to the strip contacts by baking with conductive gold paste. For convenience the inner voltage contacts are spaced one centimeter apart. A known electrical current is applied to the outer contacts and passes through the filament. The two inner contacts are connected to a high impedance voltmeter (preferably $>10^6$ ohm impedance) and the potential difference is accurately measured. Suitable filament substrates having the four spaced platinum strip contacts are commercially available from Affiliated Manufacturers of North Branch, N.J. A suitable conductive gold paste is No. 4350 gold paste, commercially available from the Cermally Co. of West Chonshohocken, Pa. When a d.c. measurement is made, the outer leads can be attached to a variable d.c. power supply such as Hewlett-Packard Model 6218A power supply which is adjusted to provide a constant current in the 10 to 100 micro-ampere range with the current being measured by means of a digital voltmeter (e.g., a Keithley Model 179 Multimeter) across a precision 5K ohm resistor. The potential difference between the inner voltage contacts can be measured directly either by a Keithley Model 179 Multimeter or recorded as a function of time on a Hewlett-Packard Model 7132A chart recorder. Alternatively, substantially identical volume resistivity values can be obtained through a.c. measurements (e.g., 60 Hertz) employing a Keithley Model 503 milliohm meter. Measurements can be carried out continuously during the intercalation. Prior to conducting the measurements the filament samples are initially heated at 80° to 100° C. in a vacuum oven at a pressure of 10 Torr or less for 1 to 1.5 hours to remove any adsorbed moisture and are then transferred to a controlled atmosphere chamber for electrical conductivity measurement and intercalation. The electrical conductivity and electrical resistivity then are calculated in accordance with standard procedures taking into consideration the measured potential difference, the gauge length (i.e., 1 cm.), and the filament cross-sectional area.

Normally, the capability of a material to conduct electricity is characterized by its resistivity which is an intrinsic property of that material. If the material is highly electroconductive, then the reciprocal of resistivity, called conductivity is also often used. (In the past, these were sometimes termed specific resistance and specific conductance, respectively.) The resistivity of a material, $\rho$, is defined as its electrical resistance per unit length per unit reciprocal cross-sectional area perpendicular to the current-carrying direction, or mathematically $\rho=RA/l$, where R is the resistance of the material (ohms), A is the cross-sectional area of the conductor (cm.$^2$) and l is the length of the conductor (cm.), so that the dimensions of the resistivity are in ohm cm. Similarly, the conductivity, $\sigma$, is the electrical conductance, K (i.e., 1/R), per unit cross-sectional area per unit reciprocal length, or $\sigma=Kl/A$. With the resistivity or conductivity expressed in this manner, however, the weight of the material is not taken into account at all, only its volume. Many of the best and most commonly used highly conductive materials are metals having high densities. For example, density, d, of copper=8.96 grams per cubic centimeter (g./cc.); silver d=10.5 g./cc., or tungsten d=19.3 g./cc. Consequently, when substantial quantities of such conductors are used to make a large conductive part, such as a power cable, this part may be quite heavy. There are numerous applications requiring parts having a reasonably high conductance as well as minimum weight. Examples are electrical leads and cables in missiles, aircraft, spaceships, or military ground transport vehicles, in which even relatively small savings in weight translate in greatly increased operating range, fuel savings, or improved performance. In such cases, the important criterion for the electrical performance of a conductive material is not its conductivity, but rather the conductivity divided by density, $\sigma$/d, or what will henceforth be called specific conductivity, thus denoting that the weight of the conductor has been taken into account. The specific electrical conductivity can be thought of as representing the conductance of a rectangular specimen having a unit length and a transverse cross-sectional area of such dimensions that the weight of the specimen equal one unit; e.g., 1 gram, if CGS units are used. In this system its dimensions are then, ohm$^{-1}$ g. $^{-1}$ cm.$^2$. The reciprocal of the specific electrical conductivity is the specific electrical resistivity.

The following examples are given as specific illustrations of the present invention. It should be understood, however, that the invention is not limited to the specific details set forth in the examples.

EXAMPLE I

A carbonaceous fibrous material containing in excess of 99 percent carbon by weight which was derived from an acrylonitrile homopolymer initially was selected. This fibrous material was commercially available from the Celanese Corporation as Celion GY-70 carbon fiber and possessed a denier per filament of approximately 0.8 to 1.0. The filaments thereof possessed a "dogbone" configuration and were initially provided as a flat tape consisting of multifilament yarn bundles. The carbonaceous fibrous material had been processed at a maximum temperature of approximately 2850° C. during its formation, and incorporated turbostratic graphitic carbon. Additionally, the fibrous material exhibited an average Young's modulus of approximately 85,000,000 psi, an average tensile strength of approximately 395,000 psi, and a density of 2.01 grams/cm$^3$. As indicated in FIG. 1, this fibrous material when subjected to wide-angle x-ray diffraction analysis exhibited unresolved and fully overlapped Miller index (100, 101) reflections and the absence of a (112) reflection. See also FIGS. 3 and 5 which illustrate microdensitometer traces of portions of the x-ray reflections of FIG. 1 which confirm the unresolved nature of the (100/101) doublet reflection, and the absence of the (112) reflection.

This commercially available carbonaceous fibrous material next was structurally modified by heating the yarn bundle at approximately 3050° C. in accordance with the concept of the present invention. The carbonaceous fibrous material while in yarn form was unwound from a revolving bobbin and continuously was passed through the cylindrical graphite susceptor of a high temperature tube furnace provided with a flowing nonoxidizing nitrogen atmosphere wherein the heat treatment was accomplished. The susceptor was heated inductively by means of a copper coil powered by a 100 KW Inductotherm generator. Oxygen was excluded from the tube furnace by means of the outflow of nitrogen. The yarn while axially suspended in the graphite susceptor was passed through the tube furnace at a rate of 5 inches per minute and was heated for approximately 96 seconds as it passed through an 8 inch hot zone provided at approximately 3050° C. as determined by means of a Leeds and Northrup optical pyrometer. While passing through the tube furnace a force of approximately 4 pounds or 0.04 grams per denier was applied to the yarn bundle. The structually modified carbonaceous fibrous material continued to incorporate turbostatic graphitic carbon and exhibited an average Young's modulus of approximately 113,000,000 psi, an average tensile strength of 350,000 psi, and a density of 2.12 grams/cm.$^3$. As indicated in FIG. 2, this structurally modified fibrous material when subjected to wide-angle x-ray diffraction analysis exhibited resolved Miller index (100) and (101) reflections and the presence of a (112) reflection. See also FIGS. 4 and 6 which illustrate microdensitometer traces of portions of the x-ray reflections of FIG. 2 which confirm the presence of the separated Miller index (100) and (101) reflections, and the presence of a (112) reflection. When analyzed in accordance with the procedure previously described, the structurally modified fibers exhibited an integrated intensity rate $I_{101}/I_{100}$ of 1.25. This compares to an $I_{101}/I_{100}$ value of less than 0.2 obtained when the carbonaceous fibrous material was subjected to the same analysis prior to the heat treatment in which it was structurally modified. Also, when analyzed in accordance with the procedure previously described the presence of the (112) reflection was further confirmed by the relatively high value of the integrated intensity ratio $I_{112}/I_{110}$ of 0.71. This compares to a value of less than 0.1 obtained when the carbonaceous fibrous material was subjected to the same analysis prior to the heat treatment in which it was structurally modified.

A filament of the structurally modified carbonaceous fibrous material which possessed a denier per filament of 0.88 next was intercalated with a fluorosulfonic acid intercalating agent. The filament was mounted in accordance with the standard four point measuring technique, dried, and positioned within a Pyrex glass reaction flask the lid of which was equipped with four electrical lead-ins and an opening for the introduction of the intercalating agent. Continuous readings of electrical resistivity were taken. Seven milliliters of >99 percent fluorosulfonic acid (supplied by the ROC/RIC Chemical Co.) were introduced into the flask provided at room temperature (i.e., at approximately 25° C.) by means of a syringe so that the filament was completely covered.

The following electrical values were observed:

| | Resistance | Conductance |
|---|---|---|
| Prior to introduction of intercalant: | 573 ohms | $1.75 \times 10^{-3}$ ohms$^{-1}$ |
| 10 minutes following introduction: | 22 ohms | $45.5 \times 10^{-3}$ ohms$^{-1}$ |
| 60 minutes following introduction: | 20 ohms | $50 \times 10^{-3}$ ohms$^{-1}$ |

It will be noted that there was a large and rapid drop in resistance, i.e., corresponding increase in conductance. These values became practically constant after about 60 minutes.

From the reacted filament denier of 0.95 and the density of 2.30 grams/cm.$^3$ the following electrical values were computed for the intercalated product:

| | Volume Conductivity |
|---|---|
| Prior to introduction of intercalant: | $0.38 \times 10^4$ ohm$^{-1}$ cm.$^{-1}$ |
| 10 minutes following introduction: | $9.9 \times 10^4$ ohm$^{-1}$ cm.$^{-1}$ |
| 60 minutes following introduction: | $10.9 \times 10^4$ ohm$^{-1}$ cm.$^{-1}$ |

The final specific conductivity was $4.74 \times 10^4$ ohm$^{-1}$ g.$^{-1}$ cm.$^2$ which was approaching the $6.58 \times 10^4$ ohm$^{-1}$ g.$^{-1}$ cm.$^2$ value for the specific conductivity of pure copper. It further was found that the final conductivity value remained unchanged following storage for one week in a dry ambient atmosphere. Additionally, the final intercalated fibrous material exhibited an average Young's modulus of approximately 112,000,000 psi, and an average tensile strength of approximately 360,000 psi.

The intercalation with the fluorosulfonic acid was repeated employing structurally modified filaments from the same source as that intercalated in Example I. Following intercalation the filaments were washed with a nitromethane solvent and were dried in a vacuum oven at 80° C. for 1.5 hours. The fluorine content of the intercalated filaments as determined by electrochemical analysis was found to be 3.7 percent by weight. This indicates that the intercalated filaments contained approximately 19.5 percent by weight of fluorosulfonic acid.

For comparative purposes the intercalation of Example I was repeated with another filament from the same source with the exception the carbonaceous fibrous material was not structurally modified by heating at 3050° C. prior to intercalation as described. It was found that the electrical resistance of the filament was higher initially and decreased upon intercalation at a much lower rate. The resistance and conductance values remained essentially unchanged after 180 minutes instead of after 60 minutes as observed in Example I. More specifically, the following electrical values were observed:

| | Resistance | Conductance |
|---|---|---|
| Prior to introduction of intercalant: | 1070 ohms | $0.93 \times 10^{-3}$ ohms$^{-1}$ |
| 10 minutes following introduction: | 890 ohms | $1.12 \times 10^{3}$ ohms$^{-1}$ |
| 60 minutes following introduction: | 113 ohms | $8.85 \times 10^{3}$ ohms$^{-1}$ |
| 180 minutes following introduction: | 68 ohms | $14.7 \times 10^{-3}$ ohms$^{-1}$ |

From the reacted filament denier of 0.80 and the density of 2.01 grams/cm.$^3$ the following electrical conductivity values were computed:

| | Volume Conductivity |
|---|---|
| Prior to introduction of intercalant: | $0.21 \times 10^4$ ohm$^{-1}$ cm.$^{-1}$ |
| 10 minutes following introduction: | $0.25 \times 10^4$ ohm$^{-1}$ cm.$^{-1}$ |
| 60 minutes following introduction: | $2.0 \times 10^4$ ohm$^{-1}$ cm.$^{-1}$ |
| 180 minutes following introduction: | $3.3 \times 10^4$ ohm$^{-1}$ cm.$^{-1}$ |

It will be noted that this volume conductivity value following intercalation was several times lower than that achieved in Example I, and requires a considerably longer time to achieve. Also the final specific conductivity was only $1.65 \times 10^4$ ohm$^{-1}$ g.$^{-1}$ cm.$^2$ when compared to the $4.74 \times 10^4$ ohm$^{-1}$ g.$^{-1}$ cm.$^2$ value achieved in Example I.

EXAMPLE II

Example I was repeated with another structurally modified filament from the same source with the exception that a subsequent intercalation with an antimony pentafluoride intercalating agent followed the initial intercalation with the fluorosulfonic acid intercalating agent. The fluorosulfonic acid was decanted from the filament and was replaced with liquid antimony pentafluoride so as to cover the filament. Prior to intercalation the filament exhibited a denier of 0.85 and a density of 2.12 grams/cm.$^3$.

The following electrical values were observed upon contact with the fluorosulfonic acid and antimony pentafluoride intercalants.

| | Resistance | Conductance |
|---|---|---|
| Prior to introduction of fluorosulfonic acid intercalant: | 658 ohms | $1.52 \times 10^{-3}$ ohms$^{-1}$ |
| 10 minutes following introduction of fluorosulfonic acid intercalant: | 26 ohms | $38.5 \times 10^{-3}$ ohms$^{-1}$ |
| 60 minutes following introduction of fluorosulfonic acid intercalant: | 23 ohms | $43.5 \times 10^{-3}$ ohms$^{-1}$ |
| 5 minutes following introduction of antimony pentafluoride intercalant: | 15 ohms | $66.7 \times 10^{-3}$ ohms$^{-1}$ |
| 60 minutes following introduction of antimony pentafluoride intercalant: | 14 ohms | $71.4 \times 10^{-3}$ ohms$^{-1}$ |

After 60 minutes while in contact with the antimony pentafluoride intercalant, the resistance and conductance values remained essentially unchanged.

From the reacted filament denier of 0.95 and the density of 2.33 grams/cm.$^3$ the following electrical values were computed for the intercalated product:

| | Volume Conductivity |
|---|---|
| Prior to introduction of fluorosulfonic acid intercalant: | $0.36 \times 10^4$ ohm$^{-1}$ cm.$^{-1}$ |
| 10 minutes following introduction of fluorosulfonic acid intercalant: | $8.5 \times 10^4$ ohm$^{-1}$ cm.$^{-1}$ |
| 60 minutes following introduction of fluorosulfonic acid intercalant: | $9.6 \times 10^4$ ohm$^{-1}$ cm.$^{-1}$ |
| 5 minutes following introduction of antimony pentafluoride intercalant: | $14.7 \times 10^4$ ohm$^{-1}$ cm.$^{-1}$ |
| 60 minutes following introduction of antimony pentafluoride intercalant: | $15.8 \times 10^4$ ohm$^{-1}$ cm.$^{-1}$ |

The final specific conductivity was $6.78 \times 10^4$ ohm$^{-4}$ g.$^{-1}$ cm.$^2$ which exceeded the $6.58 \times 10^4$ ohm$^{-1}$ g.$^{-1}$ cm.$^2$ value for the specific conductivity of pure copper. Additionally, the final intercalated fibrous material exhibited an average Young's modulus of approximately 70,000,000 psi, and an average tensile strength of approximately 182,000 psi.

The intercalation with the fluorosulfonic acid and antimony pentafluoride was repeated employing a known quantity of structurally modified filaments from the same source. Following such intercalation the filaments were washed with a nitromethane solvent and were dried in a vacuum oven at 80° C. for 1.5 hours. The antimony content was determined and found to be 12.4 percent by weight. This indicates that the intercalated filaments had incorporated about 1.5 mole percent of antimony pentafluoride.

For comparative purposes the intercalation of Example II was repeated with another filament from the same source with the exception that the carbonaceous fibrous material was not structurally modified by heating at 3050° C. prior to intercalation as described. Prior to intercalation the filament exhibited a denier of 0.90, and a density of 2.01 grams/cm$^3$. It was found that the electrical resistance of the filament was higher initially and decreased upon intercalation at a much lower rate. More specifically, the following electrical values were observed upon contact with the fluorosulfonic acid and antimony pentafluoride intercalants:

| | Resistance | Conductance |
|---|---|---|
| Prior to introduction of fluorosulfonic acid intercalant: | 1053 ohms | $0.95 \times 10^{-3}$ ohms$^{-1}$ |
| 10 minutes following introduction of fluorosulfonic acid intercalant: | 573 ohms | $1.75 \times 10^{-3}$ ohms$^{-1}$ |
| 60 minutes following introduction of fluorosulfonic acid intercalant: | 48 ohms | $20.8 \times 10^{-3}$ ohms$^{-1}$ |
| 10 minutes following introduction of antimony pentafluoride intercalant: | 33 ohms | $30.3 \times 10^{-3}$ ohms$^{-1}$ |
| 30 minutes following introduction of antimony pentafluoride intercalant: | 30 ohms | $33.3 \times 10^{-3}$ ohms$^{-1}$ |

After 30 minutes in contact with the antimony pentafluoride intercalant, the resistance and conductance values remained substantially unchanged.

From the reacted filament denier of 2.11 and the density of 2.20 grams/cm.$^3$ following intercalation the following electrical values were computed:

| | Volume Conductivity |
|---|---|
| Prior to introduction of fluorosulfonic acid intercalant: | $0.17 \times 10^4$ ohm$^{-1}$ cm.$^{-1}$ |
| 10 minutes following introduction of fluorosulfonic acid intercalant: | $0.31 \times 10^4$ ohm$^{-1}$ cm.$^{-1}$ |
| 60 minutes following introduction of fluorosulfonic acid intercalant: | $3.75 \times 10^4$ ohm$^{-1}$ cm.$^{-1}$ |
| 10 minutes following introduction of antimony pentafluoride intercalant: | $5.46 \times 10^4$ ohm$^{-1}$ cm.$^{-1}$ |
| 30 minutes following introduction of antimony pentafluoride intercalant: | $6.0 \times 10^4$ ohm$^{-1}$ cm.$^{-1}$ |

It will be noted that this volume conductivity value following intercalation was considerably lower than that achieved in Example II. Also, the final specific conductivity was only $2.7\times10^4$ ohm$^{-1}$ g.$^{-1}$ cm.$^2$ when compared to the $6.78\times10^4$ ohm$^{-1}$ g.$^{-1}$ cm.$^2$ value achieved in Example II.

The intercalation with the fluorosulfonic acid and antimony pentafluoride was repeated employing a known quantity of the non-structurally modified filaments from the same source. Following such intercalation the filaments were washed with nitromethane solvent and were dried in a vacuum oven at 80° C. for 1.5 hours. The antimony content was determined and found to be 11.1 percent by weight. This indicates that the intercalated filaments incorporated about 1.3 mole percent of antimony pentafluoride.

EXAMPLE III

Example I was repeated with the exception that the sole intercalating agent employed was antimony pentafluoride. Prior to intercalation the structurally modified filament exhibited a denier of 0.85 and a density of 2.12 grams/cm.$^3$.

The following electrical values were observed upon contact with the antimony pentafluoride intercalant:

| | Resistance | Conductance |
|---|---|---|
| Prior to introduction of antimony pentafluoride intercalant: | 695 ohms | $1.44 \times 10^{-3}$ ohms$^{-1}$ |
| 10 minutes following introduction of antimony pentafluoride intercalant: | 36 ohms | $27.8 \times 10^{-3}$ ohms$^{-1}$ |
| 30 minutes following introduction of antimony pentafluoride intercalant: | 13 ohms | $76.9 \times 10^{-3}$ ohms$^{-1}$ |

From the reacted filament denier of 1.05 and the density of 2.40 grams/cm.$^3$ the following electrical values were computed for the intercalated product:

| | Volume Conductivity |
|---|---|
| Prior to introduction of antimony pentafluoride intercalant: | $0.30 \times 10^4$ ohm$^{-1}$ cm.$^{-1}$ |
| 10 minutes following introduction of antimony pentafluoride intercalant: | $5.7 \times 10^4$ ohm$^{-1}$ cm.$^{-1}$ |
| 30 minutes following introduction of antimony pentachloride intercalant: | $15.8 \times 10^4$ ohm$^{-1}$ cm.$^{-1}$ |

The final specific conductivity was $6.6\times10^4$ ohm$^{-1}$ g.$^{-1}$ cm.$^2$ which is slightly higher than that of pure copper.

The intercalation with antimony pentafluoride was repeated employing a known quantity of structurally modified filaments from the same source. Following such intercalation the filaments were washed with a nitromethane solvent and were dried in a vacuum oven at 80° C. for 1.5 hours. The antimony content was determined and found to be 13.4 percent by weight. This indicates that the intercalated filaments had incorporated about 1.7 mole percent of antimony pentafluoride.

EXAMPLE IV

Example I was repeated with another structurally modified filament from the same source with the exception that the intercalation was accomplished at room temperature (i.e., at approximately 25° C.) by contact with a 50/50 percent by weight mixture of fluorosulfonic acid and antimony pentafluoride which was obtained from the Ozark-Mahoning Co. of Tulsa, Okla. Prior to intercalation the filament exhibited a denier of 0.80 and a density of 2.12 grams/cm.$^3$.

The following electrical values were observed upon contact with the mixture of intercalants:

| | Resistance | Conductance |
|---|---|---|
| Prior to introduction of intercalants: | 680 ohms | $1.47 \times 10^{-3}$ ohms$^{-1}$ |
| 10 minutes following introduction: | 16 ohms | $62.5 \times 10^{-3}$ ohms$^{-1}$ |
| 60 minutes following introduction: | 11.5 ohms | $87.0 \times 10^{-3}$ ohms$^{-1}$ |
| 3 hours following introduction: | 11 ohms | $90.9 \times 10^{-3}$ ohms$^{-1}$ |

After 3 hours while in contact with the mixture of intercalants, the resistance and conductance values remained substantially unchanged.

From the reacted filament denier of 1.2 and the density of 2.54 grams/cm.$^3$ the following electrical values were computed for the intercalated product:

| | Volume Conductivity |
|---|---|
| Prior to introduction of intercalants: | $0.35 \times 10^4$ ohm$^{-1}$ cm.$^{-1}$ |
| 10 minutes following introduction: | $11.9 \times 10^4$ ohm$^{-1}$ cm.$^{-1}$ |
| 60 minutes following introduction: | $16.6 \times 10^4$ ohm$^{-1}$ cm.$^{-1}$ |
| 3 hours following introduction: | $17.3 \times 10^4$ ohm$^{-1}$ cm.$^{-1}$ |

The final specific conductivity was $6.82\times10^4$ ohm$^{-1}$ g.$^{-1}$ cm.$^2$ which exceeded the $6.58\times10^4$ ohm$^{-1}$ g.$^{-1}$ cm.$^2$ value for the specific conductivity of pure copper. Additionally, the final intercalated fibrous material exhibited an average Young's modulus of approximately 89,000,000 psi, and an average tensile strength of 220,000 psi.

For comparative purposes the intercalation of Example IV was repeated with another filament from the same source with the exception that the carbonaceous fibrous material was not structurally modified by heating of 3050° C. prior to intercalation as described. Prior to intercalation the filament exhibited a denier of 0.80 and a density of 2.0 grams/cm.$^3$. It was found that the electrical resistance was higher initially and decreased upon intercalation at a much lower rate. More specifically, the following electrical values were observed upon contact with the mixture of intercalants:

| | Resistance | Conductance |
|---|---|---|
| Prior to introduction of intercalants: | 1140 ohms | $0.88 \times 10^{-3}$ ohms$^{-1}$ |
| 10 minutes following introduction: | 440 ohms | $2.27 \times 10^{-3}$ ohms$^{-1}$ |
| 60 minutes following introduction: | 150 ohms | $6.7 \times 10^{-3}$ ohms$^{-1}$ |
| 16 hours following introduction: | 29 ohms | $34.5 \times 10^{-3}$ ohms$^{-1}$ |

After 16 hours while in contact with the mixture of intercalants, the resistance and conductance values remained substantially constant.

From the reacted filament denier of 0.95 and the density of 2.35 grams/cm.$^3$ following intercalation the following electrical values were computed:

| | Volume Conductivity |
|---|---|
| Prior to introduction of intercalants: | $0.20 \times 10^4$ ohm$^{-1}$ cm.$^{-1}$ |
| 10 minutes following introduction: | $0.51 \times 10^4$ ohm$^{-1}$ cm.$^{-1}$ |
| 60 minutes following introduction: | $1.48 \times 10^4$ ohm$^{-1}$ cm.$^{-1}$ |
| 16 hours following introduction:. | $7.7 \times 10^4$ ohm$^{-1}$ cm.$^{-1}$ |

It will be noted that the volume conductivity value following intercalation was considerably lower than that achieved in Example IV. Also, the final specific conductivity was only $3.28 \times 10^4$ ohm$^{-1}$ cm.$^2$ when compared to the $6.82 \times 10^4$ ohm$^{-1}$ g.$^{-1}$ cm.$^2$ value achieved in Example IV.

EXAMPLE V

Example I was repeated with another of the structurally modified filaments from the same source with the exception that a pair of different electron acceptor intercalating agents were utilized. More specifically, the filament initially was intercalated with pure nitric acid and subsequently with arsenic pentafluoride. Prior to intercalation the filament exhibited a denier of 0.85 and a density of 2.12 grams/cm.$^3$. The initial intercalation with nitric acid was carried out at 57° C. for 15 minutes, and excess nitric acid was removed following the intercalation by heating at 80° C. under a vacuum of less than 10 millitorr. The filament next was transferred while under dry nitrogen to a Monel reaction vessel which was backfilled with gaseous arsenic pentafluoride at room temperature (i.e., at approximately 25° C.) and 1 atmosphere pressure (absolute). The filament was maintained in the arsenic pentafluoride for 18 hours.

The following electrical values were observed upon contact with the nitric acid and arsenic pentafluoride intercalants:

| | Resistance | Conductance |
|---|---|---|
| Prior to introduction of nitric acid intercalant: | 610 ohms | $1.64 \times 10^3$ ohm$^{-1}$ |
| 15 minutes following introduction of nitric acid intercalant: | 102 ohms | $9.8 \times 10^3$ ohm$^{-1}$ |
| 18 hours following introduction of arsenic pentafluoride intercalant: | 12 ohms | $83.3 \times 10^3$ ohm$^{-1}$ |

From the reacted filament denier of 0.90 and the density of 2.17 grams/cm.$^3$ the following electrical values were computed for the intercalated product:

| | Volume Conductivity |
|---|---|
| Prior to introduction of nitric acid intercalant: | $0.37 \times 10^4$ ohm$^{-1}$ cm.$^{-1}$ |
| 15 minutes following introduction of nitric acid intercalant: | $2.2 \times 10^4$ ohm$^{-1}$ cm.$^{-1}$ |
| 18 hours following introduction of arsenic pentafluoride intercalant: | $18.1 \times 10^4$ ohm$^{-1}$ cm.$^{-1}$ |

The final specific conductivity was $8.33 \times 10^4$ ohm$^{-1}$ g.$^{-1}$ cm.$^2$ which exceeded the $6.58 \times 10^4$ ohm$^{-1}$ g.$^{-1}$ cm.$^2$ value for the specific conductivity of copper.

For comparative purposes the intercalation of Example V was repeated with another filament from the same source with the exception that the carbonaceous fibrous material was not structurally modified by heating at 3050° C. prior to intercalation as described. Prior to intercalation the filament exhibited a denier of 0.90 and a density of 2.01 grams/cm.$^3$.

The following electrical values were observed upon contact with the nitric acid and arsenic pentafluoride intercalants:

| | Resistance | Conductance |
|---|---|---|
| Prior to introduction of nitric acid intercalant: | 1333 ohms | $0.75 \times 10^{-3}$ohm$^{-1}$ |
| 15 minutes following introduction of nitric acid intercalant: | 208 ohms | $4.8 \times 10^{-3}$ohm$^{-1}$ |
| 18 hours following introduction of arsenic pentafluoride intercalant: | 58 ohms | $17.2 \times 10^{-3}$ohm$^{-1}$ |

From the reacted filament denier of 0.90 and the density of 2.08 grams/cm.$^3$ the following electrical values were computed for the intercalated product:

| | Volume Conductivity |
|---|---|
| Prior to introduction of nitric acid intercalant: | $0.16 \times 10^4$ ohm$^{-1}$ cm.$^{-1}$ |
| 15 minutes following introduction of nitric acid intercalant: | $1.0 \times 10^4$ ohm$^{-1}$ cm.$^{-1}$ |
| 18 hours following introduction of arsenic pentafluoride intercalant: | $3.6 \times 10^4$ ohm$^{-1}$ cm.$^{-1}$ |

It will be noted that the volume conductivity following intercalation was considerably lower than that achieved in Example V. Also, the specific conductivity was only $1.73 \times 10^4$ ohm$^{-1}$ g.$^{-1}$ cm.$^2$ when compared to the $8.33 \times 10^4$ ohm$^{-1}$ g.$^{-1}$ cm.$^2$ value achieved in Example V.

EXAMPLE VI

Example I was repeated with another structurally modified filament from the same source with the exception that another pair of electron acceptor intercalating agents was utilized. Specifically, the filament initially was intercalated with fluorosulfonic acid and subsequently with arsenic pentafluoride. Prior to intercalation the filament exhibited a denier of 0.85 and a density of 2.12 grams/cm.$^3$. The initial intercalation was carried out at room temperature in the Pyrex flask as described in the Example I, for about 4 hours. For the second intercalation, however, the mounted sample was transferred under a dry nitrogen atmosphere to a vacuum-tight stainless steel reaction bomb, the lid of which is provided with electrically insulating feed-through fittings in order to make the necessary electrical connections to the mounted filament. The bomb is then closed, evacuated by means of a vacuum pump to less than 10 millitorr and backfilled with gaseous arsenic pentafluoride at 1 atmosphere absolute pressure to effect the intercalation. The filament was maintained in the arsenic pentafluoride for about 20 hours.

The following electrical values were observed upon contact with the fluorosulfonic acid and the arsenic pentafluoride intercalants:

| | Resistance | Conductance |
|---|---|---|
| Prior to introduction of fluorosulfonic acid intercalant: | 708 ohms | $1.4 \times 10^{-3}$ ohms$^{-1}$ |
| 60 minutes following introduction to fluorosulfonic acid intercalant: | 530 ohms | $1.9 \times 10^{-3}$ ohms$^{-1}$ |
| 150 minutes following introduction: | 85 ohms | $11.8 \times 10^{-3}$ ohms$^{-1}$ |
| 10 minutes following introduction of arsenic pentafluoride intercalant: | 29 ohms | $34.5 \times 10^{-3}$ ohms$^{-1}$ |
| 60 minutes following introduction of arsenic pentafluoride intercalant: | 19 ohms | $52.6 \times 10^{-3}$ ohms$^{-1}$ |
| 18 hours following introduction of arsenic pentafluoride intercalant: | 15 ohms | $66.7 \times 10^{-3}$ ohms$^{-1}$ |

After 18 hours while in contact with the arsenic pentafluoride intercalant the electrical values remained substantially constant. From the reacted filament denier of 0.9 and the density of 2.16 grams/cm.$^3$ the following electrical values were computed for the intercalated product:

| | Volume Conductivity |
|---|---|
| Prior to introduction of intercalant: | $0.30 \times 10^4$ ohm$^{-1}$ cm.$^{-1}$ |
| 60 minutes following introduction of fluorosulfonic acid intercalant: | $0.41 \times 10^4$ ohm$^{-1}$ cm.$^{-1}$ |
| 150 minutes following introduction of fluorosulfonic acid intercalant: | $2.5 \times 10^4$ ohm$^{-1}$ cm.$^{-1}$ |
| 10 minutes following introduction of arsenic pentafluoride intercalant: | $7.45 \times 10^4$ ohm$^{-1}$ cm.$^{-1}$ |
| 60 minutes following introduction of arsenic pentafluoride intercalant: | $11.4 \times 10^4$ ohm$^{-1}$ cm.$^{-1}$ |
| 18 hours following introduction of arsenic pentafluoride intercalant: | $14.4 \times 10^4$ ohm$^{-1}$ cm.$^{-1}$ |

The final specific conductivity is $6.67 \times 10^4$ ohm$^{-1}$ g.$^{-1}$ cm.$^2$ which is somewhat above that of pure copper.

The above intercalation was repeated employing a known quantity of structurally modified filaments from the same source. The arsenic content was determined and found to be 16.8 percent by weight. This indicates that the intercalated filaments incorporated about 4.1 mole percent of arsenic pentafluoride.

For comparative purposes the intercalation of Example VI was repeated with another filament from the same source with the exception that the carbonaceous fibrous material was not structurally modified by heating to 3050° C. prior to the intercalation as described. Prior to the intercalation, the filament exhibited a denier of 0.85 and density of 2.01 grams/cm.$^3$. It was found that the electrical resistance was higher initially and decreased upon intercalation at a much lower rate. More specifically, the following electrical values were observed upon contact with the intercalants:

| | Resistance | Conductance |
|---|---|---|
| Prior to introduction of intercalant: | 1090 ohms | $0.92 \times 10^{-3}$ ohms$^{-1}$ |
| 180 minutes following introduction of fluorosulfonic acid intercalant: | 1055 ohms | $0.95 \times 10^{-3}$ ohms$^{-1}$ |
| 10 minutes following the introduction of arsenic pentafluoride intercalant: | 463 ohms | $2.16 \times 10^{-3}$ ohms$^{-1}$ |
| 160 minutes following introduction of arsenic pentafluoride intercalant: | 126 ohms | $7.94 \times 10^{-3}$ ohms$^{-1}$ |
| 20 hours following introduction of arsenic pentafluoride intercalant: | 48 ohms | $20.8 \times 10^{-3}$ ohms$^{-1}$ |

After the 20 hours the electrical values remained substantially unchanged. From the reacted filament denier of 0.9 and density of 2.08 grams/cm.$^3$ the following electrical values were computed for the intercalated product:

| | Volume Conductivity |
|---|---|
| Prior to introduction of intercalant: | $0.19 \times 10^4$ ohm$^{-1}$ cm.$^{-1}$ |
| 180 minutes following introduction of fluorosulfonic acid intercalant: | $0.20 \times 10^4$ ohm$^{-1}$ cm.$^{-1}$ |
| 10 minutes following introduction of arsenic pentafluoride intercalant: | $0.45 \times 10^4$ ohm$^{-1}$ cm.$^{-1}$ |
| 60 minutes following introduction of arsenic pentafluoride intercalant: | $1.65 \times 10^4$ ohm$^{-1}$ cm.$^{-1}$ |
| 20 hours following introdcution of arsenic pentafluoride intercalant: | $4.33 \times 10^4$ ohm$^{-1}$ cm.$^{-1}$ |

It will be noted that the volume conductivity values during and after the intercalation are considerably lower than those achieved with the structurally modified fiber. Also, the final specific conductivity is only $2.08 \times 10^4$ ohm$^{-1}$ g.$^{-1}$ cm.$^2$ when compared to the $6.67 \times 10^4$ ohm$^{-1}$ g.$^{-1}$ cm.$^2$ achieved with the structurally modified fiber.

Although the invention has been described with preferred embodiments, it is to be understood that variations and modifications may be employed without departing from the concept of the invention as defined in the following claims.

I claim:

1. In a process for the formation of an intercalated carbonaceous fibrous material of increased electrical conductivity wherein a carbonaceous fibrous material containing at least 90 percent carbon by weight which incorporates turbostratic graphitic carbon and is derived from a fibrous material of an acrylonitrile homopolymer or an acrylonitrile copolymer containing at least about 98 mole percent of acrylonitrile units and up to about 2 mole percent of one or more other monovinyl units copolymerized therewith is contacted with at least one electron acceptor intercalating agent; the improvement of providing said carbonaceous fibrous material prior to said intercalation in a modified form as evidenced by the ability to exhibit resolved graphitic Miller index (100) and (101) reflections and a (112) reflection when subjected to wide-angle x-ray diffraction analysis.

2. The improved process for the formation of an intercalated carbonaceous fibrous material according to claim 1 wherein said carbonaceous fibrous material prior to intercalation contains at least 95 percent carbon by weight.

3. The improved process for the formation of an intercalated carbonaceous fibrous material according to claim 1 wherein said carbonaceous fibrous material prior to intercalation contains at least 98 percent carbon by weight.

4. An improved process for the formation of an intercalated carbonaceous fibrous material according to claim 1 wherein said carbonaceous fibrous material prior to intercalation is derived from an acrylonitrile homopolymer, exhibits an average tensile strength of at least about 200,000 psi, an average Young's modulus of at least 70,000,000 psi, and a density of at least 2.10 grams/cm.$^3$.

5. An improved process for the formation of an intercalated carbonaceous fibrous material according to claim 1 wherein the ratio of the integrated intensities of the said resolved Miller index (100) and (101) reflections is at least 0.4.

6. An improved process for the formation of an intercalated carbonaceous fibrous material according to claim 1 wherein the ratio of the integrated intensities of the said Miller index (112) and (110) reflections is at least 0.3.

7. An improved process for the formation of an intercalated carbonaceous fibrous material according to claim 1 wherein said electron acceptor intercalating agent is selected from the group consisting of a protonic acid having a negative Hammett Acidity function of at least 11.0, nitric acid, a Lewis acid, and mixtures of the foregoing.

8. An improved process for the formation of an intercalated carbonaceous fibrous material according to claim 1 wherein said intercalated carbonaceous fibrous product retains at least 40 percent of the average tensile strength exhibited by the carbonaceous fibrous material immediately prior to intercalation.

9. In a process for the formation of an intercalated carbonaceous fibrous material of increased electrical conductivity wherein a carbonaceous fibrous material derived from an acrylic fibrous material containing at least 90 percent carbon by weight which incorporates turbostratic graphitic carbon is contacted with at least one electron acceptor intercalating agent; the improvement comprising selecting a carbonaceous fibrous material which is derived from a fibrous material of an acrylonitrile homopolymer or an acrylonitrile copolymer containing at least about 98 mole percent of acrylonitrile units and up to about 2 mole percent of one or more other monovinyl units copolymerized therewith, and which has been heated in a non-oxidizing atmosphere at a temperature in the range of at least 3000° C. up to approximately 3500° C. while at a pressure sufficient to prevent destruction of the original fibrous configuration prior to contact with said intercalating agent whereby the structure thereof is modified and rendered capable of undergoing intercalation to form an intercalated fibrous product of increased electrical conductivity.

10. The improved process for the formation of an intercalated carbonaceous fibrous material according to claim 9 wherein said carbonaceous fibrous material prior to intercalation contains at least 95 percent carbon by weight.

11. The improved process for the formation of an intercalated carbonaceous fibrous material according to claim 9 wherein said carbonaceous fibrous material prior to intercalation contains at least 98 percent carbon by weight.

12. An improved process for the formation of an intercalated carbonaceous fibrous material according to claim 9 wherein said carbonaceous fibrous material following said heating and prior to said contact with said intercalating agent exhibits an average tensile strength of at least 200,000 psi, an average Young's modulus of at least 70,000,000 psi, and a density of at least 2.10 grams/cm.$^3$.

13. An improved process for the formation of an intercalated carbonaceous fibrous material according to claim 9 wherein said carbonaceous fibrous material prior to said intercalation evidences resolved graphitic Miller index (100) and (101) reflections and the presence of a (112) reflection when subjected to wide-angle x-ray diffraction analysis.

14. An improved process for the formation of an intercalated carbonaceous fibrous material according to claim 13 wherein the ratio of the integrated intensities of the said resolved Miller index (100) and (101) reflections is at least 0.4.

15. An improved process for the formation of an intercalated carbonaceous fibrous material according to claim 13 wherein the ratio of the integrated intensities of the said Miller index (112) and (110) reflections is at least 0.3.

16. An improved process for the formation of an intercalated carbonaceous fibrous material according to claim 9 wherein the temperature of said non-oxidizing atmosphere is greater than 3100° C. up to approximately 3500° C. and the pressure is sufficient during the course of said heating to prevent destruction of the original fibrous configuration.

17. An improved process for the formation of an intercalated carbonaceous fibrous material according to claim 9 wherein said electron acceptor intercalating agent is selected form the group consisting of a protonic acid having a negative Hammett acidity function of at least 11.0, nitric acid, a Lewis acid, and mixtures of the foregoing.

18. An improved process for the formation of an intercalated carbonaceous fibrous material according to claim 9 wherein said intercalated carbonaceous fibrous product retains at least 40 percent of the average tensile strength exhibited by the carbonaceous fibrous material immediately prior to intercalation.

19. An intercalated carbonaceous fibrous material exhibiting a specific electrical resistivity no greater than that of copper formed by (a) heating a carbonaceous fibrous material containing at least 90 percent carbon by weight derived from a fibrous material of an acrylonitrile homopolymer or an acrylonitrile copolymer containing at least about 98 mole percent of acrylonitrile units and up to about 2 mole percent of one or more other monovinyl units copolymerized therewith which incorporates turbostratic graphitic carbon and exhibits the usual unresolved graphitic Miller index (100, 101) doublet reflection and the absence of a (112) reflection when subjected to wide-angle x-ray diffraction analysis in a non-oxidizing atmosphere at a temperature in the range of at least 3000° C. up to approximately 3500° C. while at a pressure sufficient to prevent destruction of the original fibrous configuration whereby the structure thereof is modified and rendered capable of exhibiting resolved graphitic Miller index (100) and (101) reflections and the presence of a (112) reflection when subjected to wide-angle x-ray diffraction analysis, and (b) contacting said previously modified carbonaceous fibrous material with at least one electron acceptor intercalating agent capable of imparting said specific electrical resistivity.

20. An intercalated carbonaceous fibrous material according to claim 19 wherein said carbonaceous fibrous material was derived from an acrylonitrile homopolymer.

21. An intercalated carbonaceous fibrous material according to claim 19 wherein said carbonaceous fibrous material prior to said heating contains at least 95 percent carbon by weight.

22. An intercalated carbonaceous fibrous material according to claim 19 wherein said carbonaceous fibrous material prior to said heating contains at least 98 percent carbon by weight.

23. An intercalated carbonaceous fibrous material according to claim 19 which exhibits an average tensile strength of at least 100,000 psi, and an average Young's modulus of at least 50,000,000 psi.

24. An intercalated carbonaceous fibrous material according to claim 19 wherein said carbonaceous fibrous material is heated in said non-oxidizing atmosphere at a temperature greater than 3100° C. prior to said intercalation.

25. An intercalated carbonaceous fibrous material according to claim 19 wherein following said heating the ratio of integrated intensities of the said resolved Miller index (100) and (101) reflections is at least 0.4.

26. An intercalated carbonaceous fibrous material according to claim 19 wherein following said heating and prior to said contact with said intercalating agent the ratio of the integrated intensities of the said Miller index (112) and (110) reflections is at least 0.3.

27. An intercalated carbonaceous fibrous material according to claim 19 wherein said electron acceptor intercalating agent is selected from the group consisting of a protonic acid having a negative Hammett acidity function of at least 11.0. nitric acid, a Lewis acid, and mixtures of the foregoing.

* * * * *